US006003974A

United States Patent [19]

Wilson et al.

[11] Patent Number: 6,003,974

[45] Date of Patent: Dec. 21, 1999

[54] UNITARY INTERCONNECT SYSTEM FOR AN INKJET PRINTER

[75] Inventors: Arthur King Wilson, San Diego; Patricia Susan Brown, Encinitas, both of Calif.

[73] Assignee: Hewlett-Packard Company, Palo Alto, Calif.

[21] Appl. No.: 08/900,903

[22] Filed: Jul. 25, 1997

Related U.S. Application Data

[63] Continuation of application No. 08/636,844, Apr. 23, 1996, abandoned, which is a continuation of application No. 08/430,693, Apr. 28, 1995, abandoned, which is a continuation of application No. 08/055,615, Apr. 30, 1993, abandoned.

[51] Int. Cl.[6] ..... B41J 2/01

[52] U.S. Cl. ..... 347/50; 347/37

[58] Field of Search ..... 347/37, 49, 50, 347/83; 361/749, 789; 439/67, 77

[56] References Cited

U.S. PATENT DOCUMENTS

| | | | |
|---|---|---|---|
| 3,113,248 | 12/1963 | Friedman | 361/749 |
| 4,635,073 | 1/1987 | Hanson | 346/1.1 |
| 4,709,248 | 11/1987 | Piatt et al. | 347/49 |
| 4,775,868 | 10/1988 | Sugiura | 346/140 R |
| 4,872,027 | 10/1989 | Buskirk et al. | 346/140 R |
| 4,989,317 | 2/1991 | Firl et al. | 346/75 X |
| 5,162,818 | 11/1992 | Karita et al. | 346/140 R |
| 5,359,357 | 10/1994 | Takagi et al. | 347/49 |

FOREIGN PATENT DOCUMENTS

| | | |
|---|---|---|
| 0 492 955 A2 | 7/1992 | European Pat. Off. . |
| 63-265644 | 11/1988 | Japan . |

OTHER PUBLICATIONS

Search Report dated Sep. 19, 1997, for European Patent Application No. 93120808.6.

*Primary Examiner*—Joan Pendegrass

[57] ABSTRACT

An inkjet printer including a first inkjet pen having a first electrical contact and a second inkjet pen having a second electrical contact the improvement which includes: a substrate; a third electrical contact on the substrate coupled to the first electrical contact on the first inkjet pen; a fourth electrical contact on the substrate coupled to the second electrical contact on the second inkjet pen; and a conductive layer deposited on the substrate electrically interconnecting the third electrical contact to the fourth electrical contact. The improved unitary interconnect system provides an interconnect system that reduces cost, is easier to assemble and align, and provides ground plane sharing for all of the inkjet pens.

12 Claims, 10 Drawing Sheets

FIG. 2a
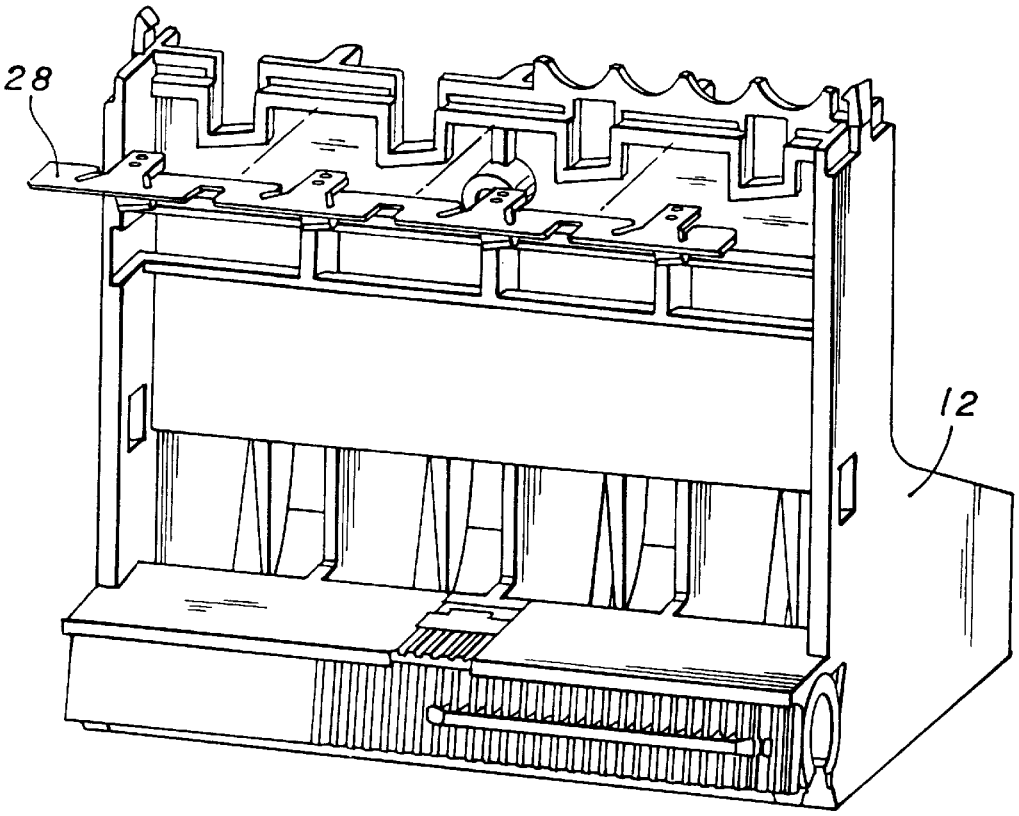
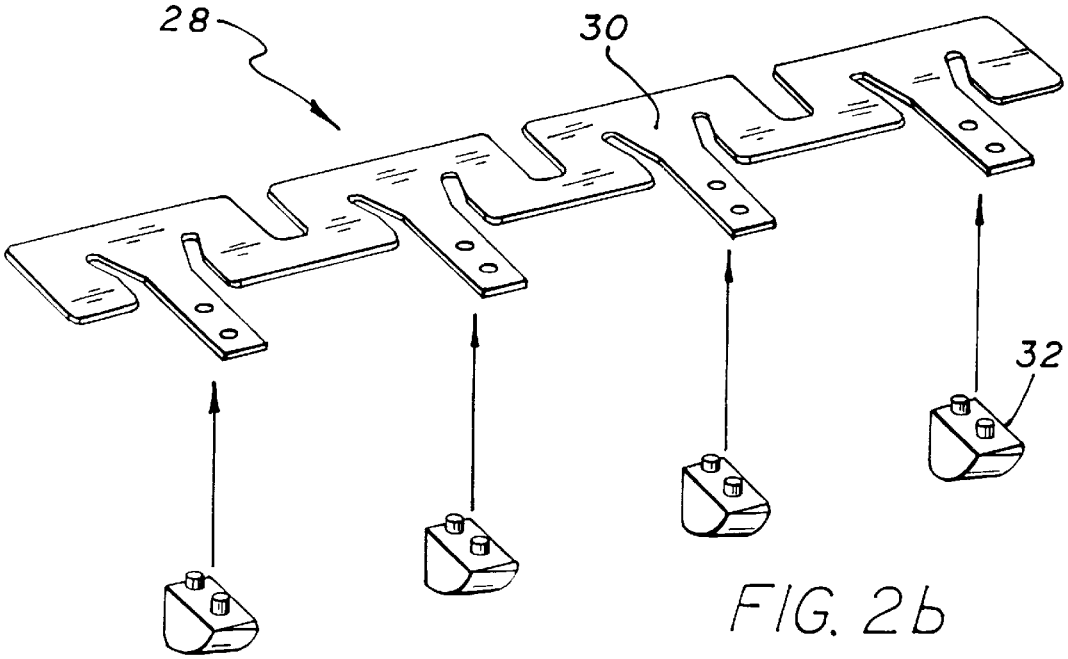
FIG. 2b

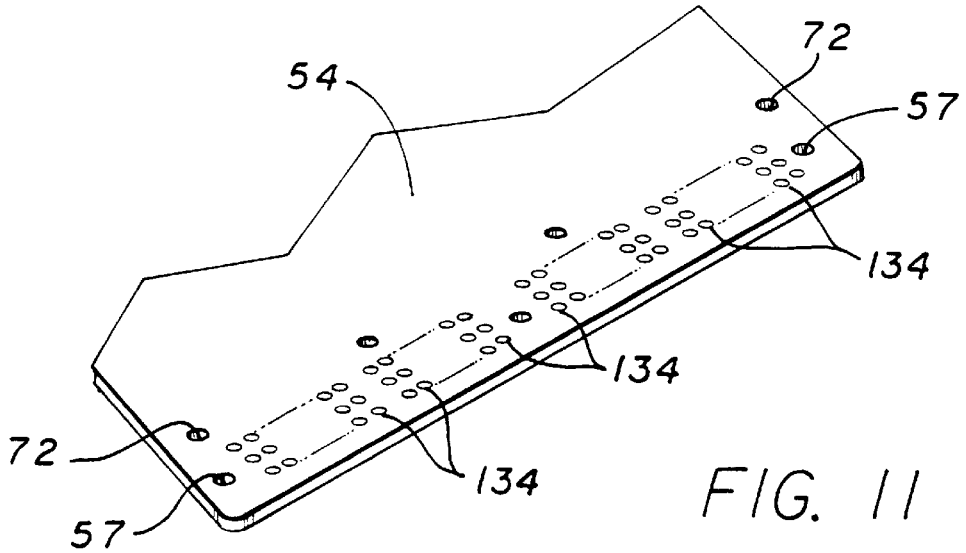
FIG. 11
FIG. 12
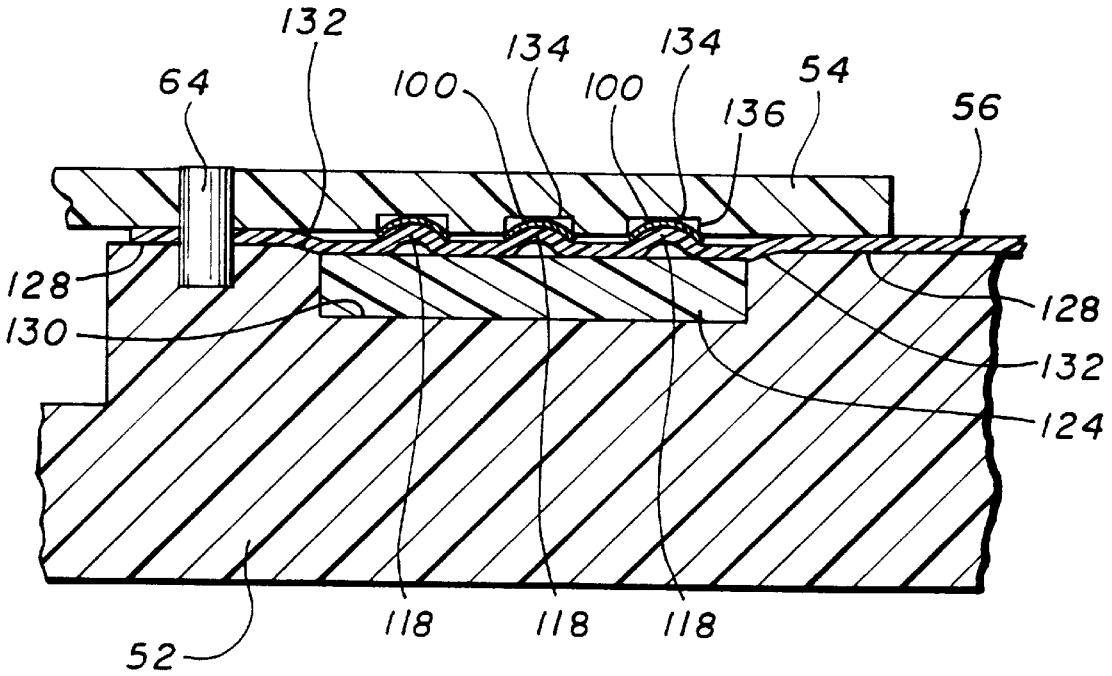

UNITARY INTERCONNECT SYSTEM FOR AN INKJET PRINTER

CROSS REFERENCE TO RELATED APPLICATION

This is a continuation of application Ser. No. 08/636,844 filed on Apr. 23, 1996, now abandoned which is a continuation of Ser. No. 08/430,693 filed Apr. 28, 1995 abandoned, which is a continuation of Ser. No. 08/055,615, filed Apr. 30, 1993 abandoned.

BACKGROUND OF THE INVENTION

1. Field of the Invention

This invention relates to interconnect systems and more particularly to interconnect systems for multiple inkjet pens in an inkjet printer.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

Inkjet printer/plotters and desktop printers, such as those sold by Hewlett Packard Company, offer substantial improvements in speed over the conventional X-Y plotter. Inkjet printer/plotters typically include a pen having an array of nozzles. The pens are mounted on a carriage which is moved across the page in successive swaths. Each inkjet pen has heater circuits which, when activated, cause ink to be ejected from associated nozzles. As the pen is positioned over a given location, a jet of ink is ejected from the nozzle to provide a pixel of ink at a desired location. The mosaic of pixels thus created provides a desired composite image.

Inkjet technology is now well known in the art. See, for example, U.S. Pat. Nos. 4,872,027, entitled PRINTER HAVING IDENTIFIABLE INTERCHANGEABLE HEADS, issued Oct. 3, 1989, to W. A. Buskirk et al. and U.S. Pat. No. 4,965,593, entitled PRINT QUALITY OF DOT PRINTERS, issued Oct. 23, 1990, to M. S. Hickman, the teachings of which are incorporated herein by reference.

Recently, full color inkjet printer/plotters and desktop printers have been developed which comprise a plurality of inkjet pens of diverse colors. A typical color inkjet printer/plotter has four inkjet pens, one that stores black ink, and three that store colored inks, e.g., magenta, cyan and yellow. The colors from the three color pens are mixed to obtain any particular color.

The pens are typically mounted in stalls within an assembly which is mounted on the carriage of the printer/plotter. The carriage assembly positions the inkjet pens and typically holds the circuitry required for interfacing to the heater circuits in the inkjet pens.

Conventionally, a carriage assembly consists of four pen stalls to align the inkjet pens, four pen clamps to hold the inkjet pens in the pen stalls, a printed circuit board having the circuitry for interfacing to the heater circuits in the inkjet pens, and four separate flexible circuits interconnected between the printed circuit board and electrical contacts on the inkjet pens. Each of these separate parts are conventionally assembled piece by piece with screws fastening the parts individually to a housing to form a carriage assembly. Assembly of these individual parts is a difficult and expensive process and special tools are required to properly align the parts.

The carriage assembly moves during printing and for quick responsiveness, it is required that the overall carriage assembly be lightweight, which results in a relatively fragile carriage assembly. If a conventional carriage assembly is accidentally bumped or one of its components fails, then repair for a conventional carriage assembly is costly, because of the multitude of individual parts and the difficult alignment process.

Conventionally, in a carriage assembly, a separate flexible circuit is used to interconnect each inkjet pen to the associated printed circuit board. The flexible circuit is made with a polyester or polyimid material such as a Mylar or Kapton substrate onto which multiple conductors are deposited. A color inkjet printer with four inkjet pens requires four separate flexible circuits.

The use of four separate flexible circuits has the disadvantages of: 1) high cost, due to the need to manufacture and stock the multiple separate flexible circuits; 2) difficulty of assembly, because of the need to route in the carriage assembly and precisely align each of the separate flexible circuits to each of the pen housings; 3) cost of assembly because the separate flexible circuits need to be separately interconnected with the printed circuit board; and 4) the need to provide separate grounds for each separate flexible circuit.

As there is typically limited interconnect area for grounds, having separate grounds for each flexible circuit limits the number of ground interconnects available for an inkjet pen. Separate grounds for each flexible circuit prevents sharing of a common ground plane for all the inkjet pens, which would be advantageous, because ground plane sharing assists in maintaining all the heater circuits in the inkjet pens at the proper ground potential regardless of which heater circuits are activated. In a conventional device, separate ground are provided for each inkjet pen, which can cause ground fluctuations and inkjet pen performance degradation, if a large number of heater circuits in one inkjet pen are activated.

Other conventional approaches to inkjet electrical interconnect include the use of edge connectors that have the disadvantages of high cost and low interconnect density.

Accordingly, there is a need in the art for an improved interconnect system that reduces cost, is easier to assemble and align, and provides ground plane sharing for all of the inkjet pens.

SUMMARY OF THE INVENTION

The need in the art is addressed by the improved unitary interconnect system for an inkjet printer of the present invention. The system includes a first inkjet pen having a first electrical contact and a second inkjet pen having a second electrical contact. The improvement is a flexible interconnect circuit which includes a substrate, a third electrical contact on the substrate coupled to the first electrical contact on the first inkjet pen, a fourth electrical contact on the substrate coupled to the second electrical contact on the second inkjet pen, and a conductive layer deposited on the substrate electrically interconnecting the third electrical contact to the fourth electrical contact.

In a specific embodiment flexible interconnect circuit includes a substrate having a first end and a second end, a first plurality of electrical contacts on the substrate near the first end of the substrate coupled to the first inkjet pen, a second plurality of electrical contacts on the substrate near the first end of the substrate coupled to the second inkjet pen, a third plurality of electrical contacts on the substrate near the second end of the substrate, and a conductive layer deposited on the substrate electrically interconnecting the first plurality of electrical contacts to the second plurality of electrical contacts and to the third plurality of electrical contacts. The number of electrical contacts in the first plurality of electrical contacts and the second plurality of electrical contacts is greater than the number of electrical contacts in the third plurality of electrical contacts.

The improved unitary interconnect of the present invention system provides an interconnect system that reduces cost, is easier to assemble and align, and provides ground plane sharing for all of the inkjet pens.

BRIEF DESCRIPTION OF THE DRAWINGS

FIGS. 2*a* and 2*b* are illustrative diagrams showing spring mechanisms for clamping the inkjet pens in a unitary housing in accordance with the present invention.

FIG. 11 is an illustrative diagram showing contacts on a circuit board corresponding to contacts on a unitary interconnect constructed in accordance with the present invention.

FIG. 12 is an illustrative diagram of an elevation section along line 12—12 of FIG. 10 of an assembled improved electrical interconnect system for a unitary interconnect constructed in accordance with the present invention.

DESCRIPTION OF THE INVENTION

Illustrative embodiments and exemplary applications will now be described with reference to the accompanying drawings to disclose the advantageous teachings of the present invention.

Figure 1A:
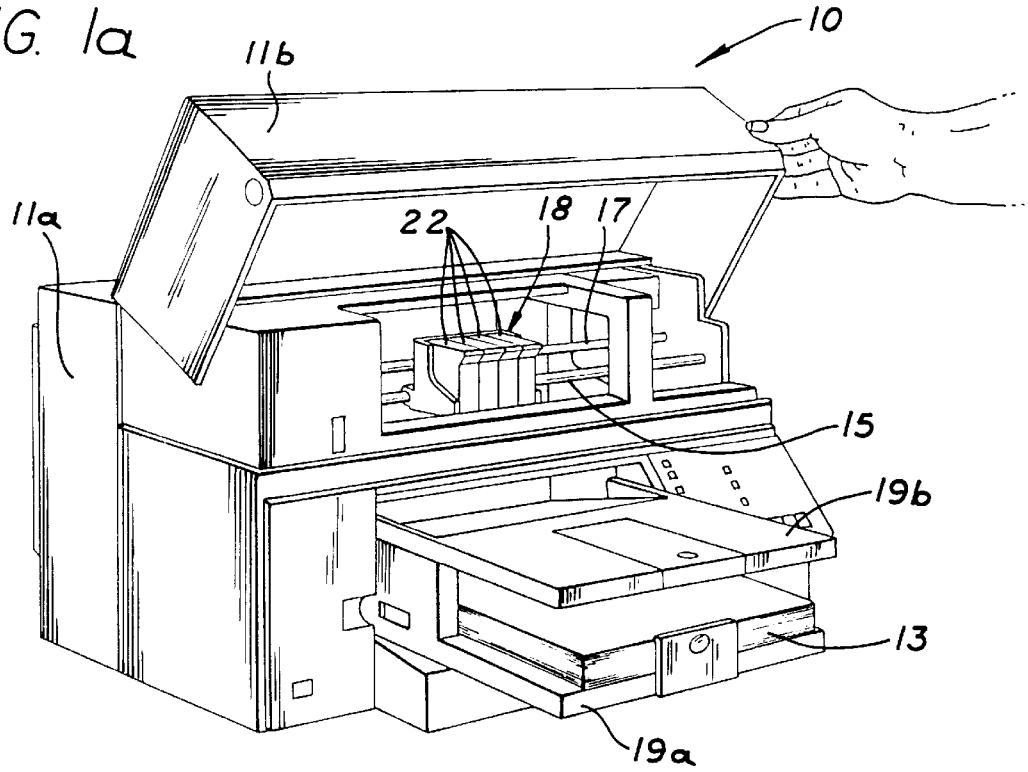
FIGS. 1*a* through 1*c* are illustrative diagrams showing an inkjet printer, inkjet pen and inkjet pens installed in a unitary housing in accordance with the present invention.

FIG. 1 is a perspective view of a thermal inkjet desktop printer incorporating the teachings of the present invention. The printer 10 includes a housing 11*a* and a protective front access lid 11*b*. A carriage assembly 18, which has four inkjet pens 22, is adapted for reciprocal motion along carriage bar 15. The position of the carriage assembly 18 in the carriage scan axis along carriage bar 15 is determined by a carriage positioning mechanism (not shown) on the carriage assembly 18 that senses its position relative to carriage encoder strip 17. An input tray 19*a* holds an media input stack 13 and after printing the printed media is held by an output tray 19*b*.

Figure 1B:
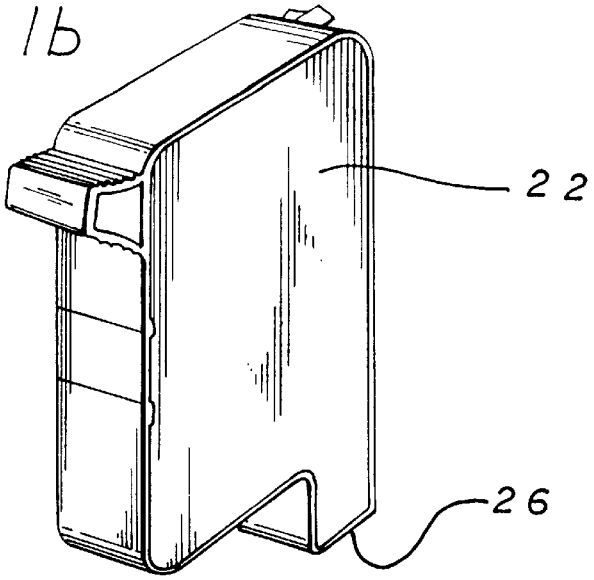
Figure 1C:
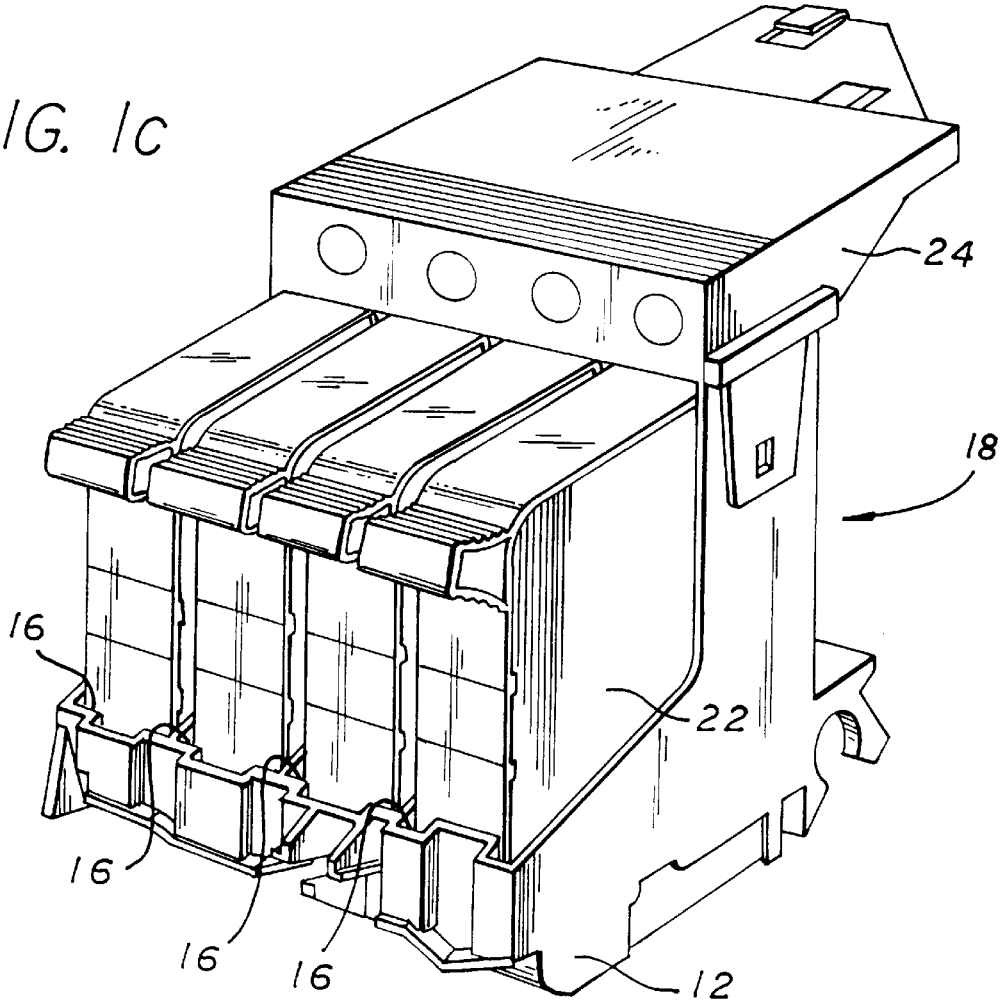

A color inkjet printer/plotter typically has four inkjet pens 22, one that stores black ink, and three that store colored inks, e.g., magenta, cyan and yellow. The colors from the three color pens are mixed to obtain any particular color. FIG. 1*b* is a detailed illustration of an inkjet pen 22 that includes heater circuits, which when activated cause ink to be ejected from the inkjet pen 22 at end 26. FIG. 1*c* illustrates carriage assembly 18 including four inkjet pens 22 installed in four pen stalls 16 in unitary housing 12 with cover 24 placed on top.

The inkjet pens 22 are held in unitary housing 12 by unitary spring clamp assembly 28, which is installed onto unitary housing 12, as shown in FIG. 2*a*. The tops of the inkjet pens 22 are retained by cam clamps 32 on unitary spring clamp assembly 28 when the inkjet pens 22 are inserted into unitary housing 12. FIG. 2*b* shows the position of cam clamps 32 on spring 30 to form unitary spring clamp assembly 28.

Figure 3A:
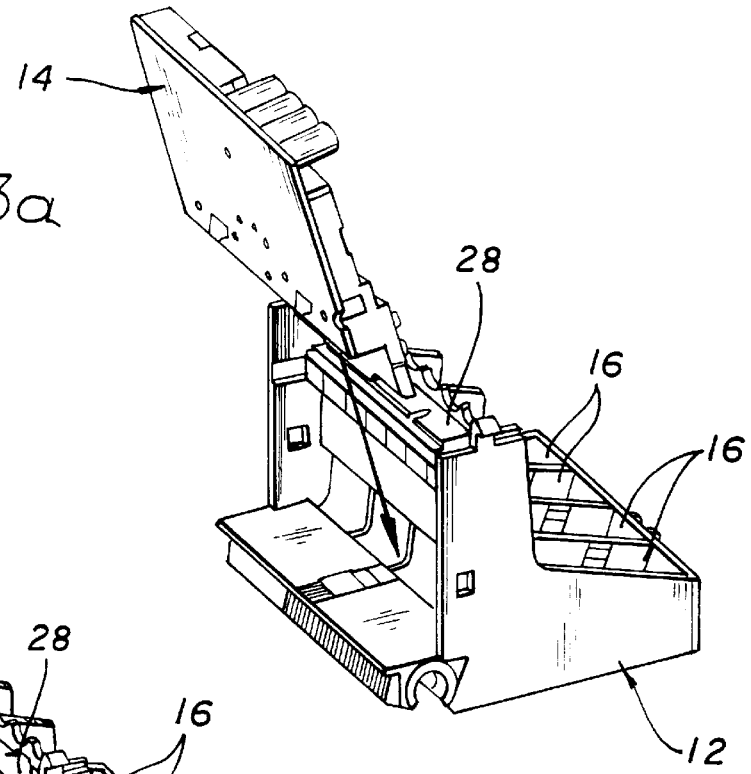
FIGS. 3*a* through 3*c* are illustrative diagrams of an improved carriage assembly showing the coupling of a removable frame circuit assembly to a unitary housing in accordance with the present invention.
Figure 3B:
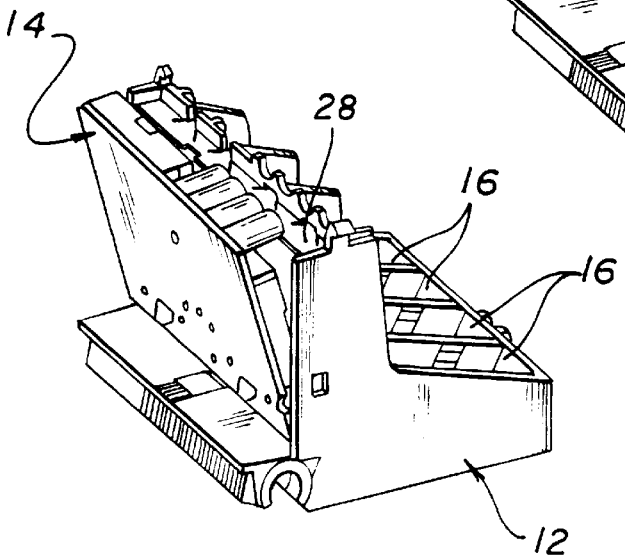
Figure 3C:
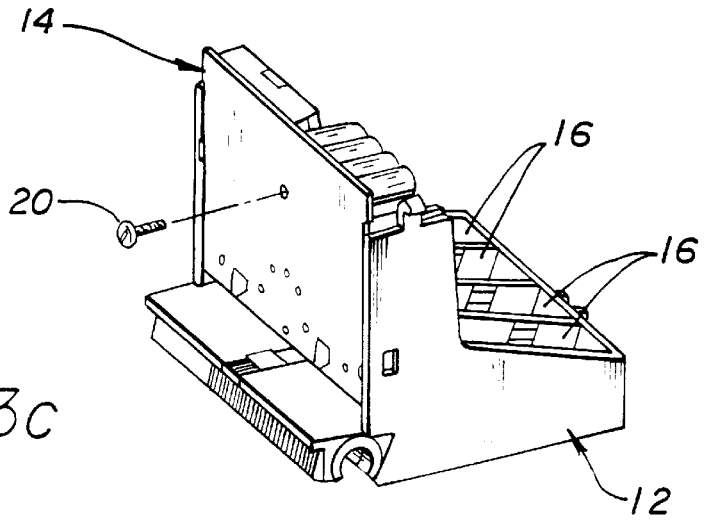

After unitary clamp assembly 28 is installed onto unitary housing 12, as shown in FIG. 2*a*, then removable frame circuit assembly 14 is placed into unitary housing 12, as shown in FIGS. 3*a* and 3*b*. Removable frame circuit assembly 14 is fastened to unitary housing 12 with a single attachment device 20, as shown in FIG. 3*c*.

Figure 4:
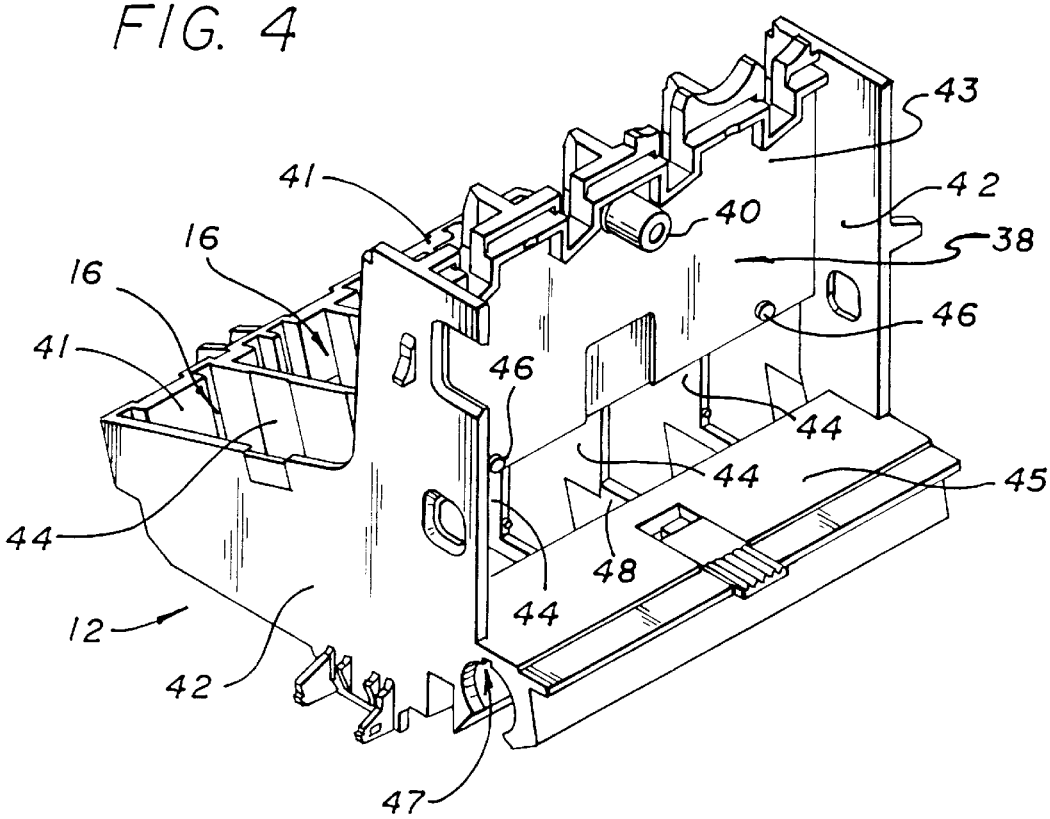
FIG. 4 is an illustrative diagram showing a unitary housing in accordance with the present invention.

FIG. 4 is an illustrative diagram showing a detailed view of the unitary housing 12 in accordance with the present invention. The unitary housing 12 is a one piece construction and retains the inkjet pens in a fixed relation to each other and the inkjet printer. A first portion 47 integral to the unitary housing extends along a first axis and is adapted to engage the carriage bar 15. The pen stalls 16 each extend along a second axis and are substantially transverse to and integral with the first portion 47. Rear compartment 38, extending along a third axis, is substantially transverse to and integral with the first and second portions and adapted to retain a substantially planar frame circuit assembly 14 within a plane defined by the first and third axes. The unitary housing provides a substantially smaller carriage assembly than the prior art.

The unitary housing 12 has a front wall 41, two lateral walls 42, three pen stall walls 44, and rear wall 43, which form four pen stalls 16. It also has a rear compartment 38 formed by lateral walls 42, rear wall 43, base 45, and the spaces between pen stall walls 44 closest to base 45. The four pen stalls 16 have passages that communicate to the rear stall between rear wall 43 and base 45 and between the pen stall walls 44. The removable frame circuit assembly 14 is installed into the rear compartment 38 in unitary housing 12, as shown in FIGS. 3*a*–3*c*. The single attachment device 20, which can be a simple screw, mates with single attachment point 40 on unitary housing 12 to attach removable frame circuit assembly 14 to unitary housing 12.

The removable frame circuit assembly 14 should be properly aligned to the unitary housing 12 because electrical contacts on the inkjet pens must make proper electrical contact with electrical contacts on the removable frame circuit assembly 14 when the pens are mounted in the pen stalls 16. The alignment of removable frame circuit assembly 14 to unitary housing 12 is provided by two vertical alignment pins 46 for vertical alignment and by single horizontal alignment wall 48 for horizontal alignment. The vertical alignment pins 46 mate with alignment holes 68 on removable frame circuit assembly 14, shown in FIG. 5*b*. The single horizontal alignment wall 48 is a vertical wall in unitary housing 12. Alignment slot 70 on removable frame circuit assembly 14, shown in FIG. 5*b*, slides over and aligns to single horizontal alignment wall 48 when the removable frame circuit assembly 14 is assembled with unitary housing 12.

Figure 5B:
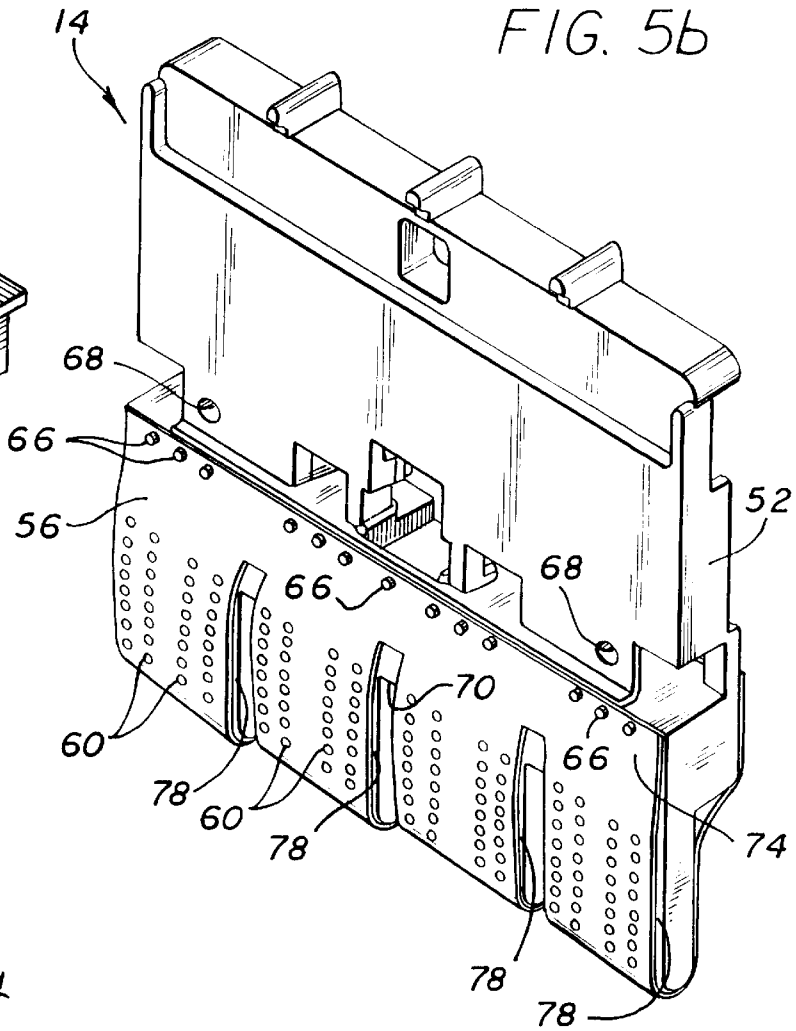
FIGS. 5*a* and 5*b* are illustrative diagrams showing the assembly of a unitary frame with a circuit board and unitary interconnect to form a removable frame circuit assembly in accordance with the present invention.
Figure 5A:
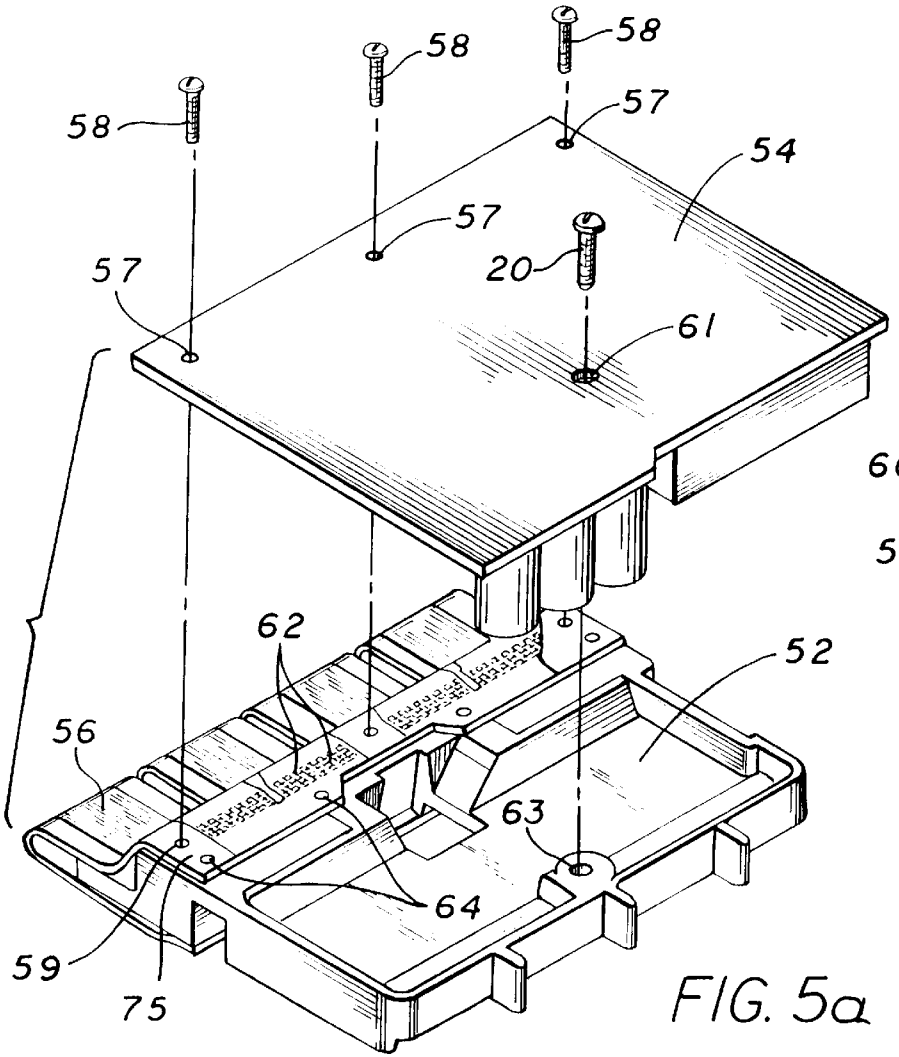
Figure 7:
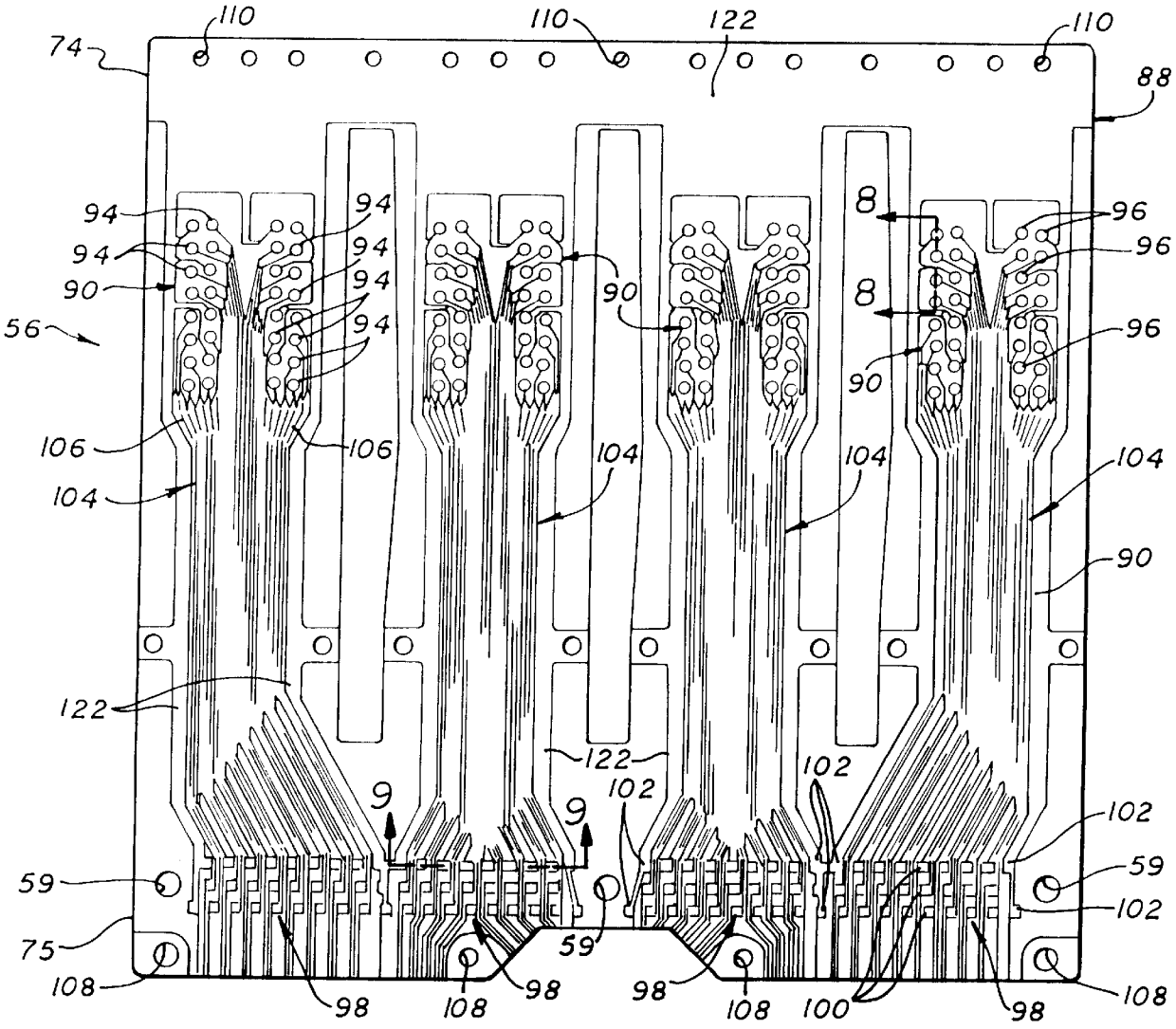
FIG. 7 is an illustrative diagram of a unitary interconnect system constructed in accordance with the present invention.

FIGS. 5*a* and 5*b* are illustrative diagrams showing the assembly of a unitary frame 52 with circuit board 54 and unitary interconnect 56 to form removable frame circuit assembly 14 in accordance with the present invention. The unitary interconnect 56 is aligned to unitary frame 52 by alignment pins 64 and unitary interconnect alignment pins 66 on unitary frame 52 that fit into alignment holes 108 and alignment holes 110, respectively, on unitary interconnect 56 as shown in FIG. 7. The unitary interconnect 56 is wrapped over extensions 78 on one end of unitary frame 52. When the frame circuit assembly 14 is installed into unitary housing 12, extensions 78 slide into the passages between pen stall walls 44 and rear wall 43 and behind base 45. This positions electrical contacts 60 for interconnection with electrical contacts on the inkjet pens 22.

The unitary interconnect 56 provides a shorter interconnect between the inkjet pens 22 and the circuit board 54 than the separate flexible circuits for each inkjet pen of the prior art. This is partially a result of the substantially smaller carriage assembly provided by unitary housing 12.

The unitary interconnect 56 has two areas of electrical contacts: electrical contacts 60 on unitary interconnect first end 74 and electrical contacts 62 on unitary interconnect second end 75. The electrical contacts 62 interconnect with circuit board 54. The electrical contacts 60 are for electrical interconnection with the inkjet pens 22 held in pen stalls 16. As shown in FIG. 5*a*, the circuit board 54 is attached to the unitary frame 52 with devices such as screws 58 that pass through circuit board attachment holes 57 and unitary interconnect holes 59 and into unitary frame 52. The single attachment device 20 passes through circuit board attachment hole 61 and unitary frame hole 63, when attaching removable frame circuit assembly 14 to unitary housing 12.

Figure 6A:
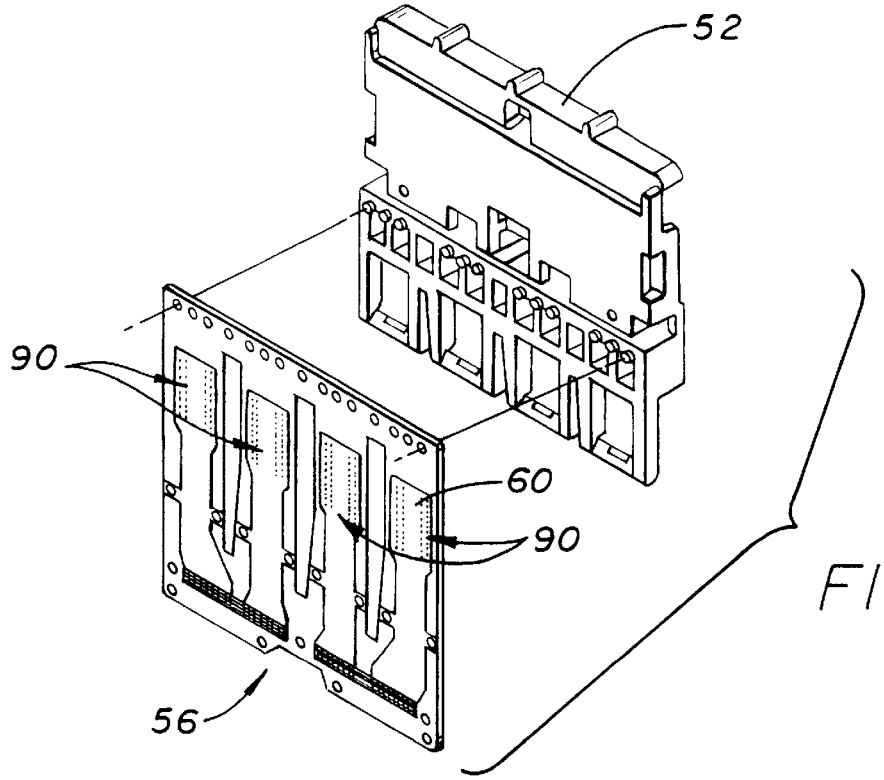
FIGS. 6*a* and 6*b* are illustrative diagrams showing the assembly of a unitary interconnect on a unitary frame with a circuit board to form a removable frame circuit assembly in accordance with the present invention.
Figure 6B:
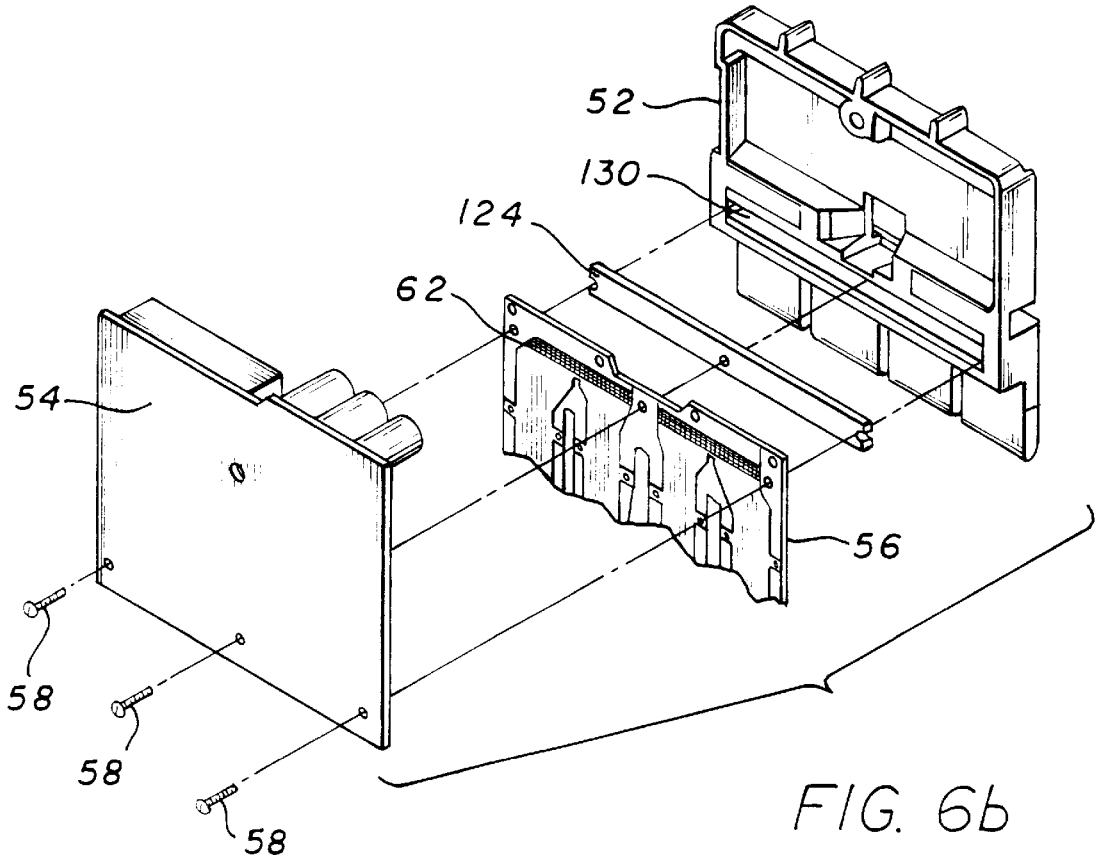

FIGS. 6*a* and 6*b* are illustrative diagrams showing the assembly of unitary interconnect 56 on unitary frame 52 and circuit board 54 to form a removable frame circuit assembly 14 in accordance with the present invention. As shown in FIG. 6*a*, the unitary interconnect 56 is first aligned and attached to unitary frame 52. Then, as shown in FIG. 6*b*, an elastomeric pad 124 is placed into recess 130 in unitary frame 52 and then the unitary interconnect 56 is wrapped over one end of unitary frame 52 and the electrical contacts 62 are aligned onto unitary frame 52 and over the elastomeric pad 124. Finally, the circuit board 54 is attached to the unitary frame 52 to make electrical contact with electrical contacts 62 on unitary interconnect 56. The electrical interconnection of the unitary interconnect 56 with the circuit board 54 is described in further detail with reference to FIG. 10 later in this specification.

FIG. 7 is an illustrative detailed diagram of the unitary interconnect 56 constructed in accordance with the present invention. The unitary interconnect 56 includes substrate 88, which for convenience of description has a unitary interconnect first end 74 and a unitary interconnect second end 75. As discussed above, alignment holes 108 and alignment holes 110 on substrate 88 are provided for alignment with the unitary frame 52.

Along unitary interconnect first end 74 of substrate 88, there are four identical individual sets of electrical signal and ground contacts 90 are provided for interconnection to the signal contacts on an inkjet pen. In the illustrative embodiment, each identical individual set of electrical signal and ground contacts 90 in FIG. 7 has twenty three electrical signal contacts 94 and nine electrical ground contacts 96. The electrical contacts 60 of FIG. 5*b* are simplified representations of the electrical signal contacts 94 and electrical ground contacts 96, as shown more accurately in FIG. 7.

Four individual sets of electrical signal contacts 98, which each have twenty three electrical signal contacts 100 are provided at unitary substrate second end 75 of substrate 88. The four individual sets of electrical traces 104, which each include twenty three electrical traces 106, interconnect the twenty three electrical signal contacts 94 of each of the identical individual sets of electrical signal and ground contacts 90 to the individual sets of electrical signal contacts 98. Sixteen total electrical ground contacts 102 are provided along the unitary interconnect second end 75 of substrate 88. The electrical contacts 62 of FIG. 5*a* are simplified representations of the electrical signal contacts 100 and electrical ground contacts 102, as shown more accurately in FIG. 7.

In an inkjet printer the number of heater circuits that is activated at any one time are determined by the pattern being printed. The advantage of the design of unitary interconnect 56 of the present invention is that a common conductive ground layer 122 is used to interconnect the nine electrical ground contacts 96 for each of the four identical individual sets of electrical signal and ground contacts 90 to all sixteen electrical ground contacts 102. Thus, a total of thirty six electrical ground contacts 96 are interconnected via common conductive ground layer 122 with sixteen electrical ground contacts 102. This addresses the problem of having limited interconnect area at unitary interconnect second end 75 for the electrical ground contacts 102 and allows sharing of all the electrical ground contacts 102 for the electrical ground contacts 96 of all of the inkjet pens. Thus, if a large number of heater circuits in one inkjet pen 22 are activated, that inkjet pen can use all sixteen electrical ground contacts 102 for a ground return. Sharing the ground contacts reduces ground fluctuations for the inkjet pens and improves performance. In a conventional device, a separate interconnect flexible circuit is provided for each inkjet pen 22 and therefore separate ground returns for each inkjet pen. Thus, in the conventional device each inkjet pen has a reduced number of electrical ground contacts, which can cause ground fluctuations if a large number of heater circuits are activated in one inkjet pen.

Figure 8:
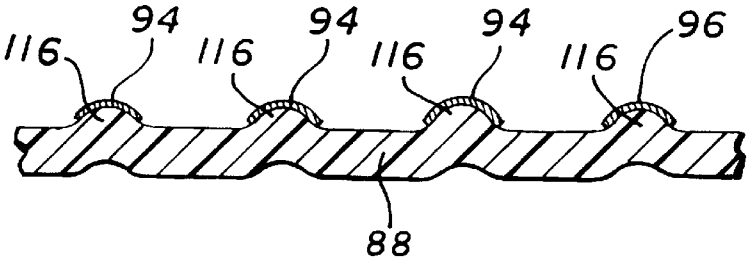
FIG. 8 is an illustrative diagram of section 8—8 of FIG. 7 showing protrusions on the unitary interconnect system for electrical signal and electrical ground contacts constructed in accordance with the present invention.
Figure 9:
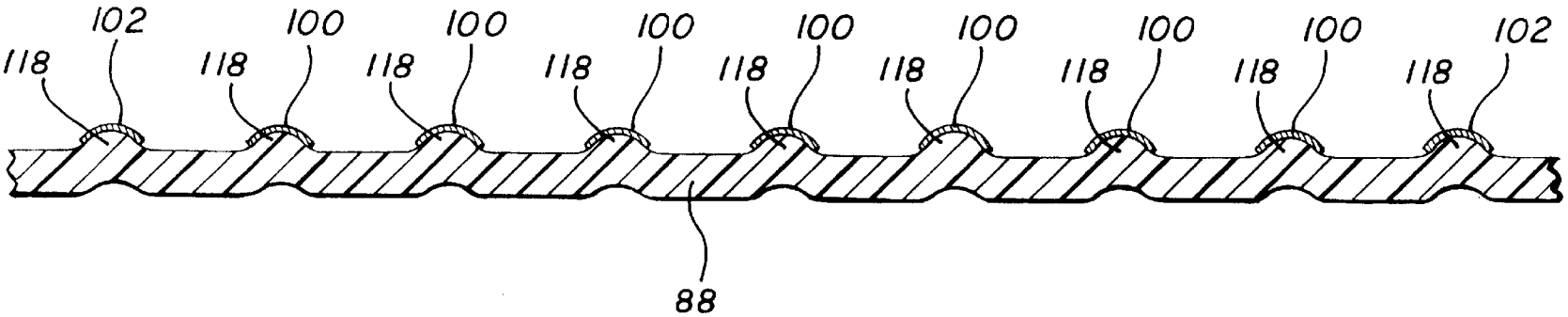
FIG. 9 is an illustrative diagram of section 9—9 of FIG. 7 showing protrusions on the unitary interconnect system for electrical signal and electrical ground contacts constructed in accordance with the present invention.

FIG. 8 is an illustrative diagram of section 8—8 of FIG. 7 showing protrusions 116 on substrate 88 constructed in accordance with the present invention. As shown in FIG. 8, electrical signal contacts 94 or electrical ground contacts 96 on protrusions 116. Similarly, FIG. 9 is an illustrative diagram of section 9—9 of FIG. 7 showing protrusions 118 on substrate 88. As shown in FIG. 9, electrical signal contacts 100 or electrical ground contacts 102 are provided on protrusions 118. The electrical contacts on protrusions 116 make contact with electrical contacts on the inkjet pens 22 and the electrical contacts on protrusions 118 make contact with electrical contacts on circuit board 54.

Figure 10:
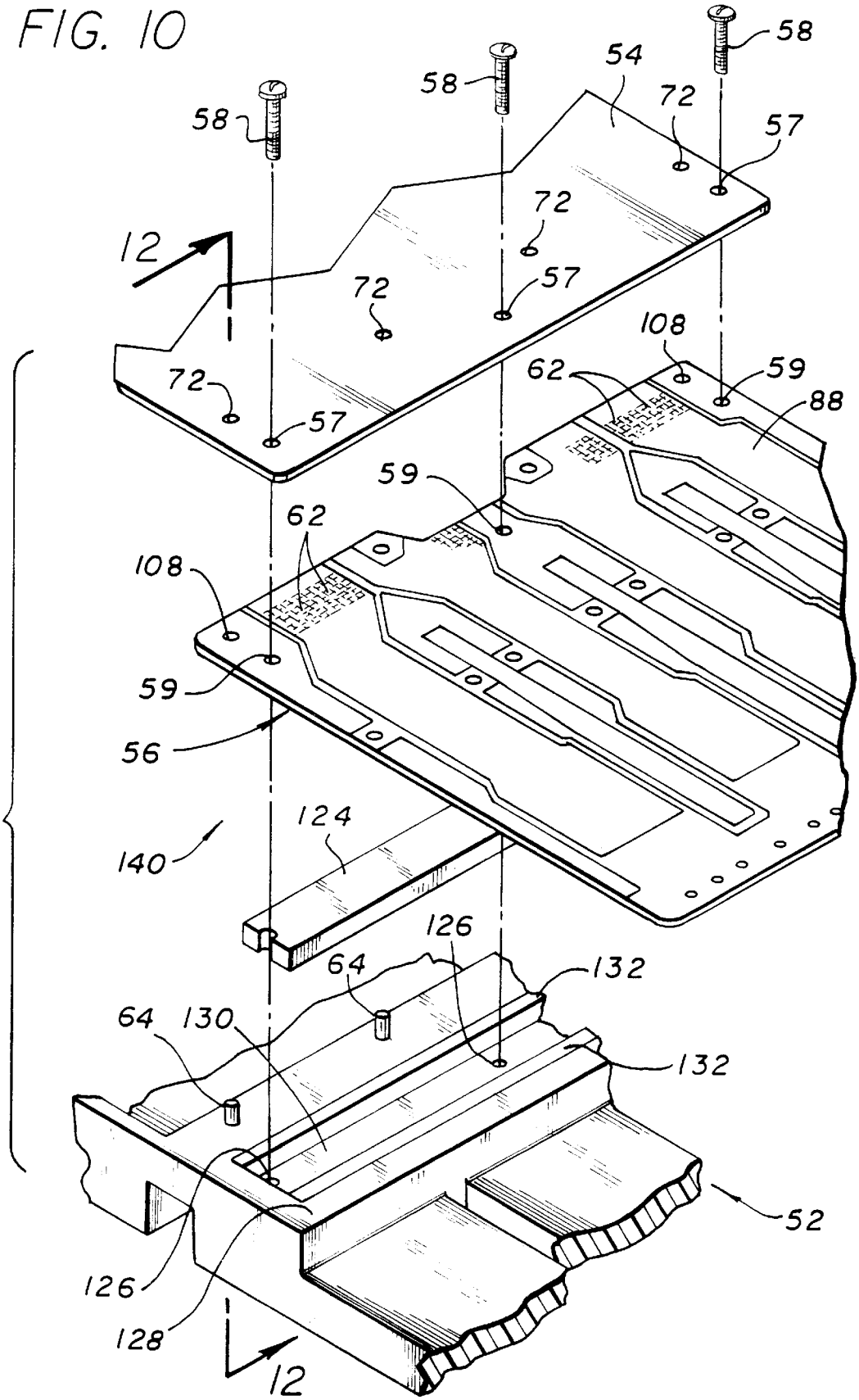
FIG. 10 is an illustrative diagram of a disassembled improved electrical interconnect system for a unitary interconnect in accordance with the present invention.

In FIG. 10 an improved electrical interconnect system 140 for a flexible circuit with a circuit board is shown. The unitary interconnect 56, shown in detail in FIG. 7, is constructed with a polyester or polyimide material such as Mylar or Kapton substrate 88 onto which multiple conductors are deposited. The conductors are made of copper and can be covered with another layer of Mylar or Kapton. Electrical contacts 62 are located on protrusions 118 on substrate 88, as shown in FIG. 9.

FIG. 11 shows the opposite side of circuit board 54 with circuit board contacts 134, which according to the present invention are interconnected with electrical contacts 62 on unitary interconnect 56. The arrangement of circuit board contacts 134 on circuit board 54 correspond to the arrangement of electrical contacts 62 on unitary interconnect 56, which is shown in detail in FIG. 7. Each of the circuit board contacts 134 are gold plated and the electrical contacts 62 are also gold plated to insure a low resistance electrical path.

As shown in FIG. 10, the circuit board 54 and unitary interconnect 56 are assembled on a unitary frame 52, which can be constructed of plastic, because only low pressure is used to interconnect circuit board contacts 134 and electrical contacts 62. An elastomeric pad 124, which can be constructed of urethane rubber, provides a spring function and is mounted into recess 130 in unitary frame 52. The improved electrical interconnect system 140 is assembled with screws 58 that are inserted through circuit board attachment hole 57 on circuit board 54 and unitary interconnect holes 59 on unitary interconnect 56 and then screwed into attachment holes 126 on unitary frame 52. The electrical contacts 62 on unitary interconnect 56 are aligned to circuit board contacts 134 on circuit board 54 by alignment pins 64 coupled to unitary frame 52, which are inserted through alignment holes 108 on unitary interconnect 56 and alignment holes 72 on circuit board 54. When the improved electrical interconnect system is assembled the electrical contacts 62 are aligned and make electrical contact with circuit board contacts 134.

FIG. 12 is an illustrative diagram of an elevation section along line 12—12 of FIG. 10 of an assembled improved electrical interconnect system for a flexible circuit constructed in accordance with the present invention. In FIG. 12 the elastomeric pad 124 is shown to fit within recess 130 in unitary frame 52. The elastomeric pad 124 provides a spring function that bears upon the electrical contacts 100 on protrusions 118 between the elastomeric pad 124 and the circuit board 54. The unitary frame 52 has bevels 132 between the recess 130 and the top surface 128 of the unitary frame 52. The object of each bevel 132 is to provide relief allowing the unitary interconnect 56 to deform during assembly so that all of the electrical contacts 100 on protrusions 118 make contact with all of the circuit board contacts 134 on circuit board 54. As the screws 58 are tightened, a portion of the unitary interconnect 56 is clamped between the top surface 128 of unitary frame 52 and the circuit board 54. Bevels 132 provide relief to the portion of unitary interconnect 56 between elastomeric pad 124 and circuit board 54.

Also shown in FIG. 12 are circuit contact recesses 136, which contain circuit board contacts 134. The circuit contact recesses 136 on circuit board 54 are the result of a coating such as a solder mask that is applied over the conductors on circuit board 54 to protect the conductors from corrosion and to prevent solder bridging. This allows for slight circuit contact recesses 136 on the order of 0.001–0.002 inches deep at each of the circuit board contacts 134, which as discussed above are gold plated. During assembly, the portion of unitary interconnect 56 between elastomeric pad 124 and circuit board 54 deforms, which allows the protrusions 118 on unitary interconnect 56 to align with the circuit contact recesses 136 on circuit board 54 to ensure proper electrical contact.

The improved electrical interconnect system for a flexible circuit 140 is easy to assemble and disassemble by simply loosening or tightening screws 58. The interconnect density may exceed 150 contacts per square inch, which provides a high density interconnect system. These desirable features are obtained while maintaining low cost and high reliability.

The improved unitary interconnect system provides an interconnect system that reduces cost, is easier to assemble and align, and provides ground plane sharing for all of the inkjet pens.

The improved carriage assembly has reduced cost and is easier to assemble, align and service without the need for any special tools.

Thus, the present invention has been described herein with reference to a particular embodiment for a particular application. Nonetheless, those having ordinary skill in the art and access to present teachings will recognize additional modifications, applications, and embodiments within the scope thereof. For example, the alignment pins of the present invention may be replaced by other equivalent devices without departing from the scope of the present invention.

It is therefore intended by the appended claims to cover any and all such applications, modifications and embodiments within the scope of the present invention.

Accordingly,

What is claimed is:

1. An inkjet printer, comprising:

a carriage assembly adapted for reciprocal motion along a carriage scan axis, the assembly including a housing defining a plurality of inkjet pen stalls for holding a corresponding plurality of inkjet pens;

a first inkjet pen adapted to be removably secured in a first one of said inkjet pen stalls, said first pen having an electrically driven printhead and including a first electrical contact array, the first array including a first plurality of pen ground contacts;

a second inkjet pen adapted to be removably secured in a second one of said inkjet pen stalls, said second pen having a second electrically driven printhead and including a second electrical contact array, the second array including a second plurality of pen ground contacts;

the carriage assembly further comprising a unitary interconnect structure for electrically interconnecting the first and second inkjet pens with other components of the printer to provide electrical drive signals and ground return paths to drive the printheads comprising the inkjet pens, the interconnect structure comprising;

a unitary nonconductive flexible substrate;

a third electrical contact array formed on said substrate for making direct electrical connection with said first electrical contact array of said first pen when said first pen is installed in a first printing position in said first pen stall, said third contact array including a third plurality of ground contacts;

a fourth electrical contact array formed on said substrate for making direct electrical connection with said second electrical contact array of said second pen when said second pen is installed in a second printing position in said second pen stall, said fourth contact array including a fourth plurality of ground contacts;

a fifth electrical contact array formed on said substrate for making electrical contact with a connection array for electrical connection to a source of electrical drive signals and to a ground for the printer, the fifth contact array including a fifth plurality of ground contacts; and a common conductive ground layer formed on said substrate, said third, fourth and fifth plurality of ground contacts electrically interconnected by the common ground layer, so that fifth group of ground contacts are shared by the third and fourth groups of ground contacts, thereby improving ground connections while simplifying electrical interconnection of the inkjet pens to the source of drive signals.

2. The printer of claim 1 wherein said fifth electrical contact array includes a first set of electrical signal contacts which are electrically connected to corresponding signal contacts of said third contact array via a first set of conductor paths formed on the substrate, the first set of contacts comprising a first subset of said fifth plurality of ground contacts, and a second set of electrical signal contacts which are electrically connected to corresponding contacts of said fourth contact array via a second set of conductor paths formed on the substrate, the second set of contacts comprising a second subset of said fifth plurality of ground contacts.

3. The printer of claim 1 wherein said third electrical contact array and said fourth electrical contact array are adjacent a first end of said substrate, and said fifth electrical contact array is near a second end of said substrate.

4. The printer of claim 3 wherein a first number of electrical contacts in said third plurality of ground contacts and said fourth plurality of ground contacts is greater than a second number of ground contacts in said fifth plurality of ground contacts.

5. The printer of claim 1 wherein said third electrical contact array comprises a first plurality of protrusions having gold deposited thereon, said fourth electrical array comprises a second plurality of protrusions having gold deposited thereon, and said fifth electrical array comprises a third plurality of protrusions having gold deposited thereon.

6. A method of connecting an interconnection to first and second inkjet pens in an inkjet printer, comprising the steps of providing a carriage assembly adapted for reciprocal motion along a printer carriage scan axis, the assembly including a housing defining a plurality of inkjet pen stalls for holding a corresponding plurality of inkjet pens;

providing a first inkjet pen adapted to be removably secured in a first one of said inkjet pen stalls, said first pen having an electrically driven printhead and including a first electrical contact array, the first array including a first plurality of pen ground contacts;

providing a second inkjet pen adapted to be removably secured in a second one of said inkjet pen stalls, said second pen having a second electrically driven printhead and including a second electrical contact array, the second array including a second plurality of pen ground contacts;

providing in the carriage assembly a unitary interconnect structure for electrically interconnecting the first and second inkjet pens with other components of the printer to provide electrical drive signals and ground return paths to drive the printheads comprising the inkjet pens, the interconnect structure comprising;

a unitary nonconductive flexible substrate;

a third electrical contact array formed on said substrate for making direct electrical connection with said first electrical contact array of said first pen when said first pen is installed in a first printing position in said first pen stall, said third contact array including a third plurality of ground contacts;

a fourth electrical contact array formed on said substrate for making direct electrical connection with said second electrical contact array of said second pen when said second pen is installed in a second printing position in said second pen stall, said fourth contact array including a fourth plurality of ground contacts;

a fifth electrical contact array formed on said substrate for making electrical contact with a connection array for electrical connection to a source of electrical drive signals and to a ground for the printer, the fifth contact array including a fifth plurality of ground contacts; and a common conductive ground layer formed on said substrate, said third, fourth and fifth plurality of ground contacts electrically interconnected by the common ground layer, so that fifth group of ground contacts are shared by the third and fourth groups of ground contacts, thereby improving ground connections while simplifying electrical interconnection of the inkjet pens to the source of drive signals;

inserting said first pen into said first pen stall so that contacts of said first contact array directly engage contacts of said third contact array; and inserting said second pen into said second pen stall so that contacts of said second contact array directly engage contacts of said fourth contact array.

7. The method of claim 6 wherein said fifth electrical contact array includes a first set of electrical signal contacts which are electrically connected to corresponding signal contacts of said third contact array via a first set of conductor paths formed on the substrate, the first set of contacts comprising a first subset of said fifth plurality of ground contacts, and a second set of electrical signal contacts which are electrically connected to corresponding contacts of said fourth contact array via a second set of conductor paths formed on the substrate, the second set of contacts comprising a second subset of said fifth plurality of ground contacts.

8. The method of claim 6 wherein said third electrical contact array and said fourth electrical contact array are adjacent a first end of said substrate, and said fifth electrical contact array is near a second end of said substrate.

9. The method of claim 8 wherein a first number of electrical contacts in said third plurality of ground contacts and said fourth plurality of ground contacts is greater than a second number of ground contacts in said fifth plurality of ground contacts.

10. The method of claim 6 wherein said third electrical contact array comprises a first plurality of protrusions having gold deposited thereon, said fourth electrical array comprises a second plurality of protrusions having gold deposited thereon, and said fifth electrical array comprises a third plurality of protrusions having gold deposited thereon.

11. An inkjet printer, comprising:

a carriage assembly adapted for reciprocal motion along a carriage scan axis, the assembly including a housing defining a plurality of inkjet pen stalls for holding a corresponding plurality of inkjet pens, said housing including one or more walls;

a first inkjet pen adapted to be removably secured in a first one of said inkjet pen stalls, said first pen having an electrically driven printhead and including a first electrical contact array, the first array including a first plurality of pen ground contacts;

a second inkjet pen adapted to be removably secured in a second one of said inkjet pen stalls, said second pen having a second electrically driven printhead and including a second electrical contact array, the second array including a second plurality of pen ground contacts;

the carriage assembly further comprising a unitary interconnect structure for electrically interconnecting the first and second inkjet pens with other components of the printer to provide electrical drive signals and ground return paths to drive the printheads comprising the inkjet pens, the interconnect structure comprising;

a unitary nonconductive flexible substrate having defined therein one or more elongated slots, each for receiving therein a portion of one of said one or more walls of said housing;

a third electrical contact array formed on said substrate for making direct electrical connection with said first electrical contact array of said first pen when said first pen is installed in a first printing position in said first pen stall, said third contact array including a third plurality of ground contacts;

a fourth electrical contact array formed on said substrate for making direct electrical connection with said second electrical contact array of said second pen when said second pen is installed in a second printing position in said second pen stall, said fourth contact array including a fourth plurality of ground contacts;

a fifth electrical contact array formed on said substrate for making electrical contact with a connection array for electrical connection to a source of electrical drive signals and to a ground for the printer, the fifth contact array including a fifth plurality of ground contacts; and a common conductive ground layer formed on said substrate, said third, fourth and fifth plurality of ground contacts electrically interconnected by the common ground layer, so that fifth group of ground contacts are shared by the third and fourth groups of ground contacts, thereby improving ground connections while simplifying electrical interconnection of the inkjet pens to the source of drive signals.

12. The printer of claim 11, wherein said carriage defines four of said pen stalls, said housing defines at least three of said walls, and said unitary flexible substrate includes at least three of said slots.

* * * * *